US009290919B2

(12) United States Patent
Blaine

(10) Patent No.: US 9,290,919 B2
(45) Date of Patent: Mar. 22, 2016

(54) MOUNTING DRIVER FOR UNDERMOUNTED SINKS

(71) Applicant: Dow Blaine, Suwanee, GA (US)

(72) Inventor: Dow Blaine, Suwanee, GA (US)

( * ) Notice: Subject to any disclaimer, the term of this patent is extended or adjusted under 35 U.S.C. 154(b) by 0 days.

(21) Appl. No.: 14/812,424

(22) Filed: Jul. 29, 2015

(65) Prior Publication Data

US 2016/0024770 A1 Jan. 28, 2016

Related U.S. Application Data

(66) Continuation-in-part of application No. 14/095,461, filed on Dec. 3, 2013, now Pat. No. 9,133,609, Substitute for application No. 61/894,748, filed on Oct. 23, 2013.

(51) Int. Cl.
*E03C 1/32* (2006.01)
*E03C 1/33* (2006.01)

(52) U.S. Cl.
CPC .. *E03C 1/335* (2013.01); *E03C 1/32* (2013.01)

(58) Field of Classification Search
CPC ..... E03C 1/335; E03C 1/33; F16B 9/026; F16B 9/02; F16B 9/00
USPC ..... 248/251; 4/632, 633, 634, 695
See application file for complete search history.

(56) References Cited

U.S. PATENT DOCUMENTS 1,253,924 A * 1/1918 Barnett ..... A47B 96/061 248/241
2,846,695 A * 8/1958 Hartog ..... E03C 1/33 108/25
3,022,519 A * 2/1962 Lang ..... E03C 1/33 220/3.6
3,229,310 A * 1/1966 Ensch ..... E03C 1/33 4/616
3,365,732 A * 1/1968 Juergens ..... E03C 1/33 4/634
3,412,727 A * 11/1968 Hurko ..... F24C 15/108 126/211
4,432,106 A * 2/1984 Smith ..... E03C 1/335 4/633
4,504,986 A * 3/1985 Vigh ..... E03C 1/335 4/633
4,613,995 A * 9/1986 Ricke ..... E03C 1/33 4/633
5,014,371 A * 5/1991 Heel ..... A45D 19/04 4/516
5,538,206 A * 7/1996 Sather ..... E03C 1/33 248/201
5,664,265 A * 9/1997 Gotter ..... E03C 1/335 4/631
5,743,501 A * 4/1998 Rapp ..... E03C 1/33 248/200.1
5,911,521 A * 6/1999 Steinmetz ..... E03C 1/33 24/306
7,429,021 B2 * 9/2008 Sather ..... E03C 1/33 248/200.1
7,698,753 B2 * 4/2010 Jones ..... E03C 1/32 248/201
8,070,110 B2 * 12/2011 Jones ..... E03C 1/33 248/200.1
8,146,873 B2 * 4/2012 Johnson ..... A47B 96/061 248/201
8,166,618 B2 * 5/2012 Eriksson ..... E03C 1/33 24/302
8,356,367 B2 * 1/2013 Flynn ..... A47K 1/05 248/500
2008/0313804 A1 * 12/2008 Osterroth ..... E03C 1/33 4/695
2010/0301175 A1 * 12/2010 Grayson ..... E03C 1/33 248/27.1
2012/0222213 A1 * 9/2012 Booth ..... A47B 77/06 4/648

* cited by examiner

*Primary Examiner* — Mark Wendell
(74) *Attorney, Agent, or Firm* — Welsh Flaxman & Gitler LLC

(57) ABSTRACT

An assembly for undermounting a sink to a support surface includes a central sink support supporting a front center portion of a sink. The central sink support includes an elongated block member having an upper surface, a lower surface and extending sidewalls. The central sink support also includes first and second screw holes shaped and dimensioned for the passage of screws that will be secured to a front wall of a sink cabinet and a threaded locking pin hole with a similarly threaded locking screw. The assembly also includes a mounting driver having a support bar shaped and dimensioned for positioning between an underside of the sink and a wall of a cabinet at an angular orientation relative to the wall. The support bar includes a first end and a second end.

10 Claims, 12 Drawing Sheets

MOUNTING DRIVER FOR UNDERMOUNTED SINKS

CROSS REFERENCE TO RELATED APPLICATIONS

This application is a continuation in part of U.S. patent application Ser. No. 14/095,461, entitled "MOUNTING DRIVER FOR UNDERMOUNTED SINKS," filed Dec. 3, 2013, which is currently pending, and which claims the benefit of U.S. Provisional Patent Application Ser. No. 61/894,748, entitled "MOUNTING DRIVER FOR UNDERMOUNTED SINKS," filed Oct. 23, 2013.

BACKGROUND OF THE INVENTION

1. Field of the Invention

The present application is directed to an undermounting system for a sink.

2. Description of the Related Art

Undermounting of sinks fully beneath the surface of a countertop has become very popular based upon the aesthetics of a countertop that is unencumbered with the rim of a sink. In addition, and without the rim of the sink mounted upon the upper surface of a countertop, there is no seam between the rim and the countertop in which dirt and grime may accumulate.

However, the ability to securely support a sink positioned beneath a granite countertop is very limited as one cannot simply screw the sink to the underside of the countertop. With this in mind, a need continues to exist for a sink supporting structure allowing for secure and stable support of the sink without the need for elaborate and expensive mounting structures.

SUMMARY OF THE INVENTION

It is, therefore, an object of the present invention to provide an assembly for undermounting a sink to a support surface. The assembly includes a central sink support supporting a front center portion of a sink and a mounting driver. The central sink support includes an elongated block member having an upper surface, a lower surface and extending sidewalls. The central sink support also includes first and second screw holes shaped and dimensioned for the passage of screws that will be secured to a front wall of a sink cabinet. The central sink support further includes a threaded locking pin hole with a similarly threaded locking screw. The mounting driver includes a support bar shaped and dimensioned for positioning between an underside of the sink and a wall of a cabinet at an angular orientation relative to the wall, the support bar including a first end and a second end.

It is also an object of the present invention to provide an assembly wherein the extending sidewalls include a front sidewall, a rear sidewall, a lateral left sidewall and a lateral right sidewall.

It is another object of the present invention to provide an assembly wherein the first and second screw holes extend between the front sidewall and the rear sidewall.

It is a further object of the present invention to provide an assembly wherein the first and second screw holes are positioned symmetrically on opposite sides of the central sink support such that they are located adjacent to the lateral left sidewall and the lateral right sidewall and between the upper surface and the lower surface thereof.

It is also an object of the present invention to provide an assembly wherein the threaded locking pin hole extends between the upper surface and the lower surface, and the threaded locking pin hole is oriented perpendicular to the first and second screw holes.

It is another object of the present invention to provide an assembly wherein the threaded locking pin hole extends between the upper surface and the lower surface.

It is a further object of the present invention to provide an assembly wherein the upper surface includes an upwardly extending stop positioned on the upper surface.

It is also an object of the present invention to provide an assembly wherein the upper surface includes an upwardly extending stop positioned on the upper surface and adjacent to a front sidewall of the central sink support.

It is another object of the present invention to provide an assembly wherein the mounting driver also includes a mounting bracket shaped and dimensioned for fixed attachment to the wall of the cabinet, the support bar being pivotally coupled to the mounting bracket.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
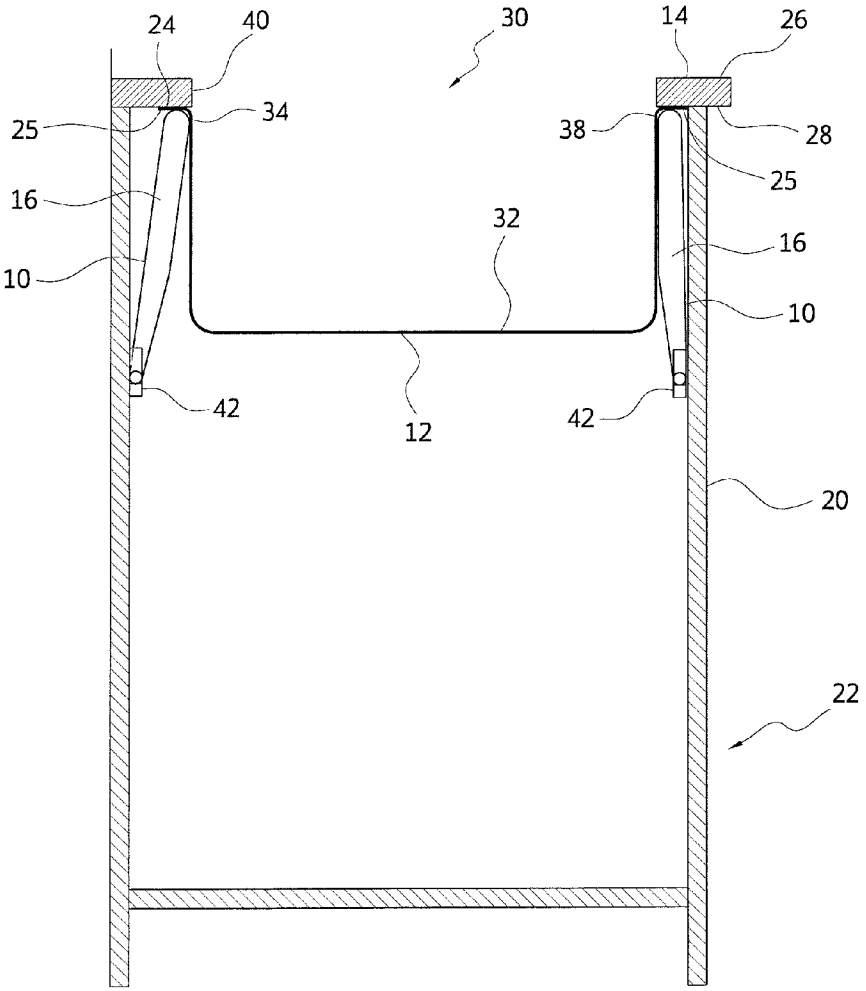
FIGS. 1 and 2 are sectional views respectively from the front of the sink and the side of the sink showing a sink undermounted to a countertop using the mounting driver in accordance with the present invention.
Figure 2:
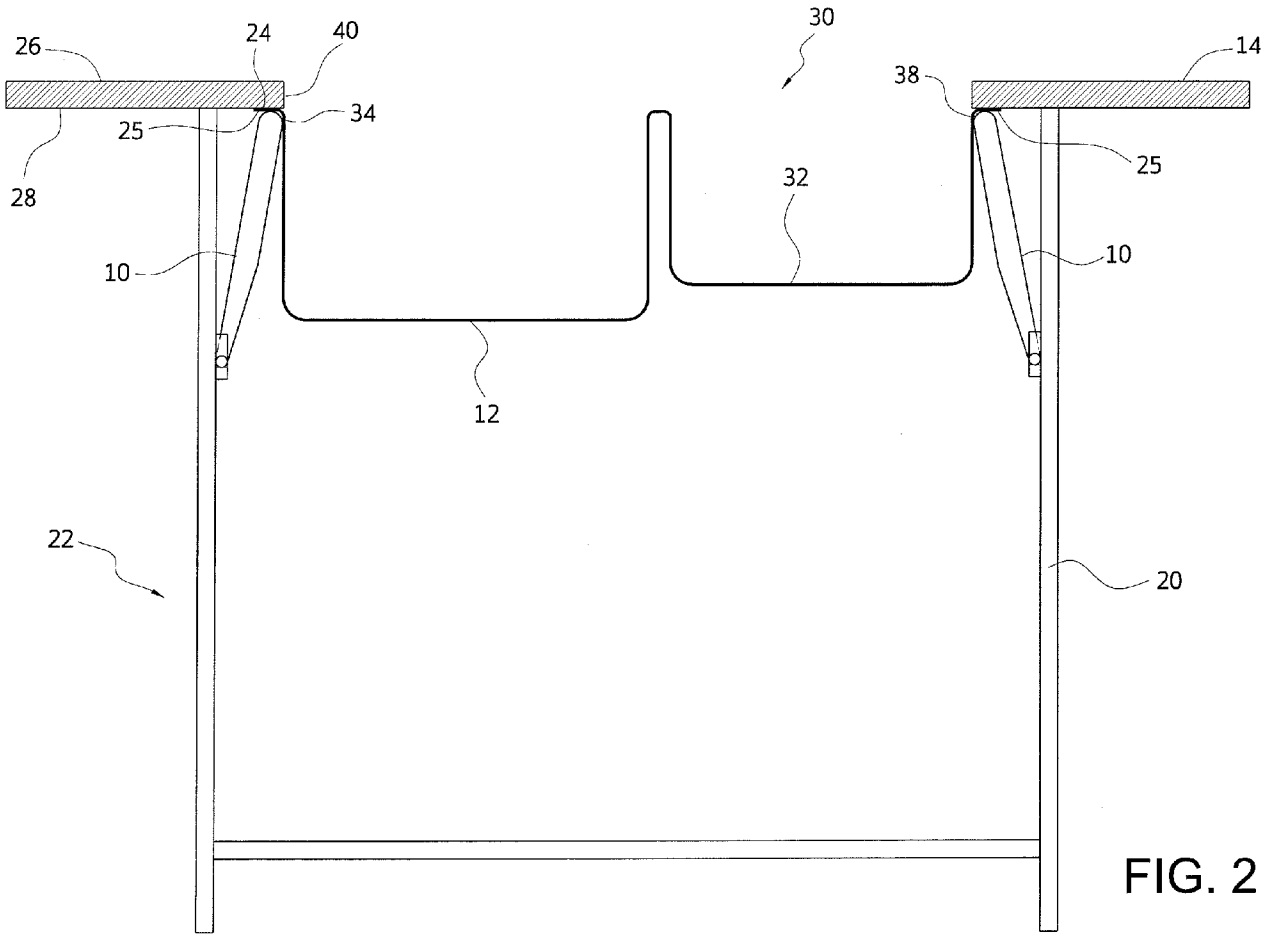
Figure 3:
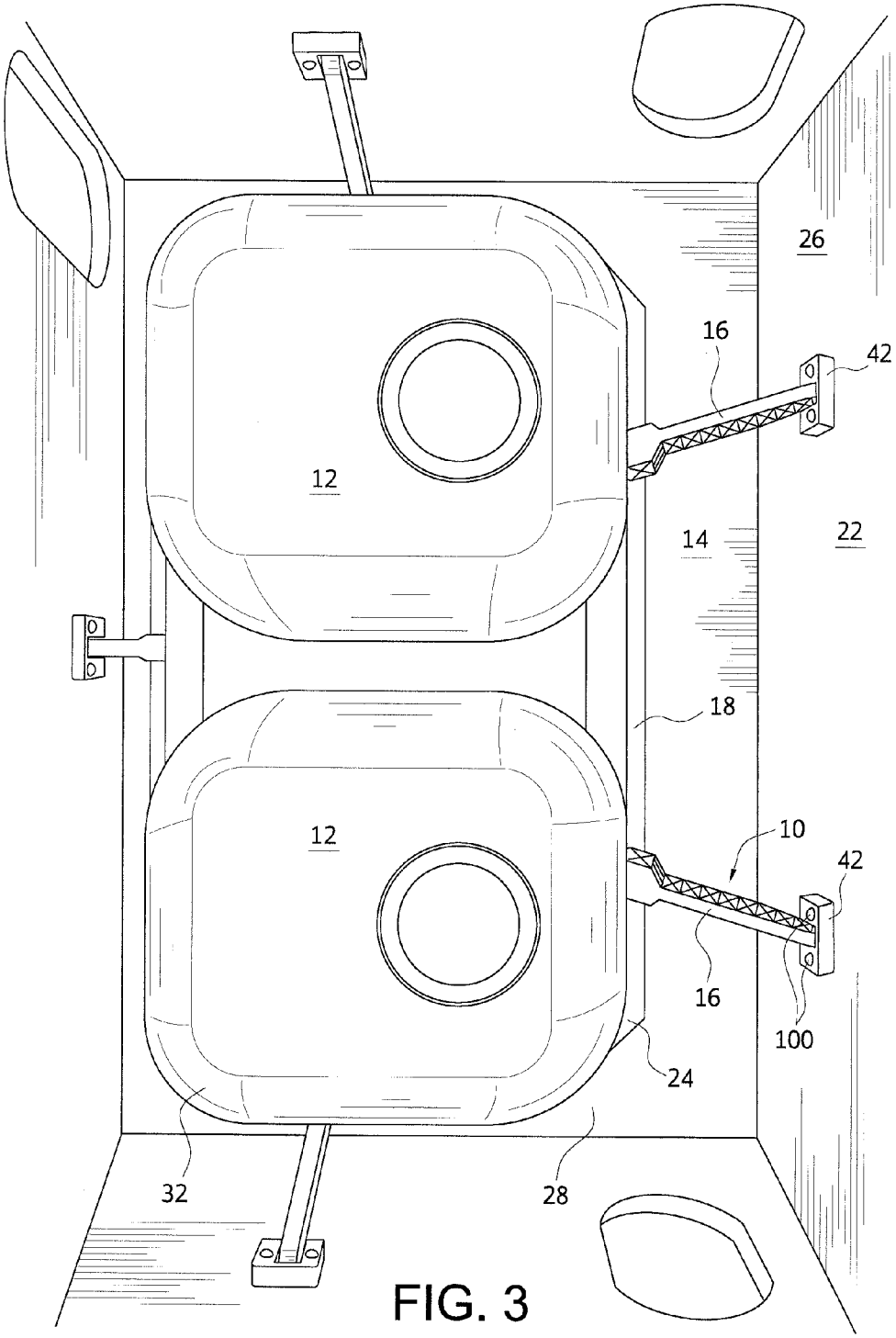
FIG. 3 is a bottom plan view of the sink undermounted to the countertop using the mounting driver in accordance with the present invention.
Figure 4:
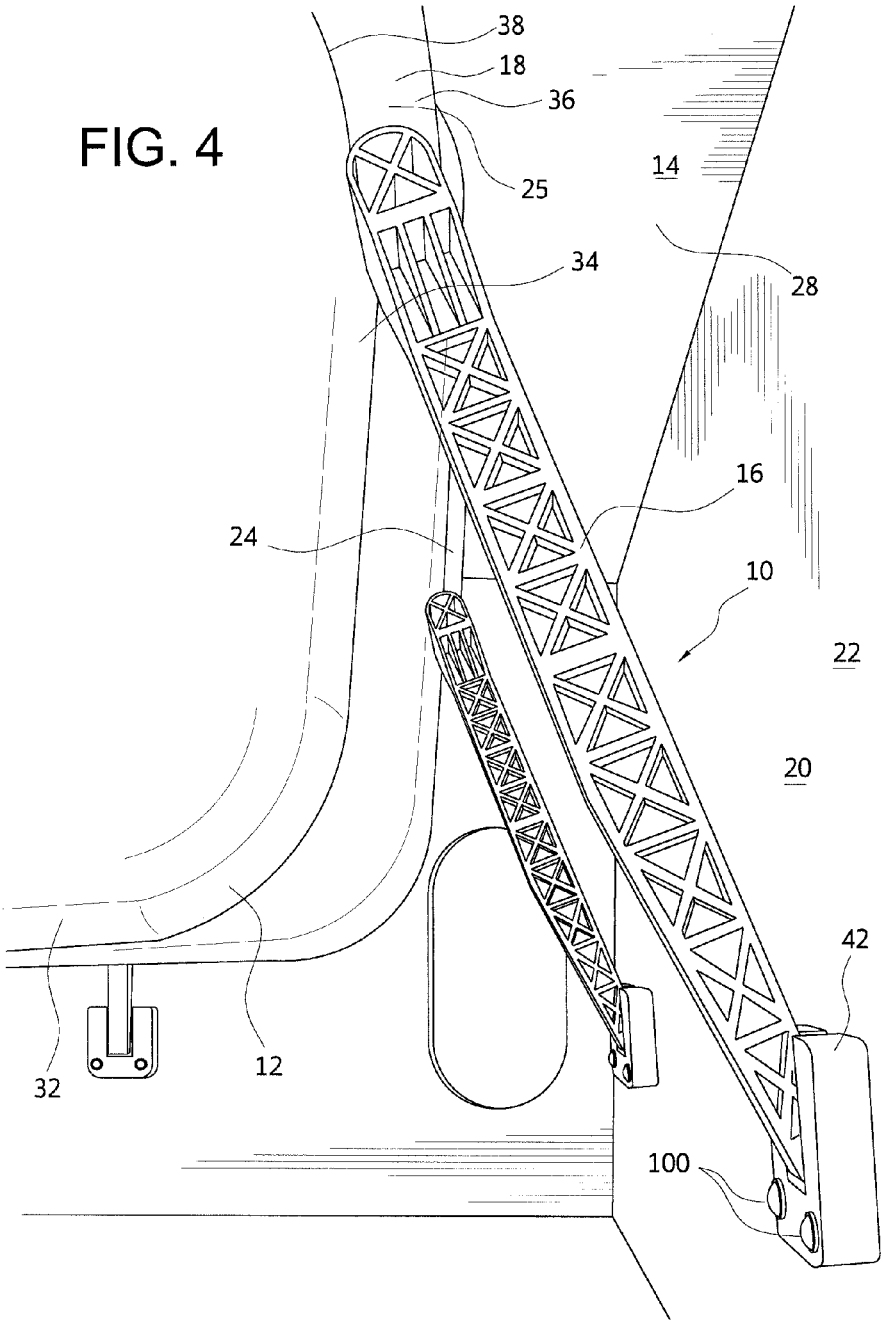
FIG. 4 is a detailed side view of the sink undermounted to the countertop using the mounting driver in accordance with the present invention.
Figure 5:
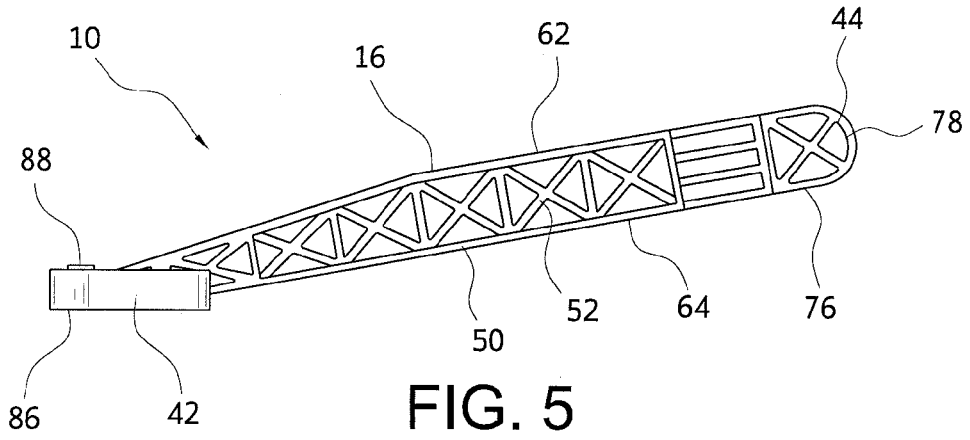
FIGS. 5, 6, and 7 are respectively a side view, a top plan view and a perspective view of the mounting driver in accordance with the present invention.
Figure 6:
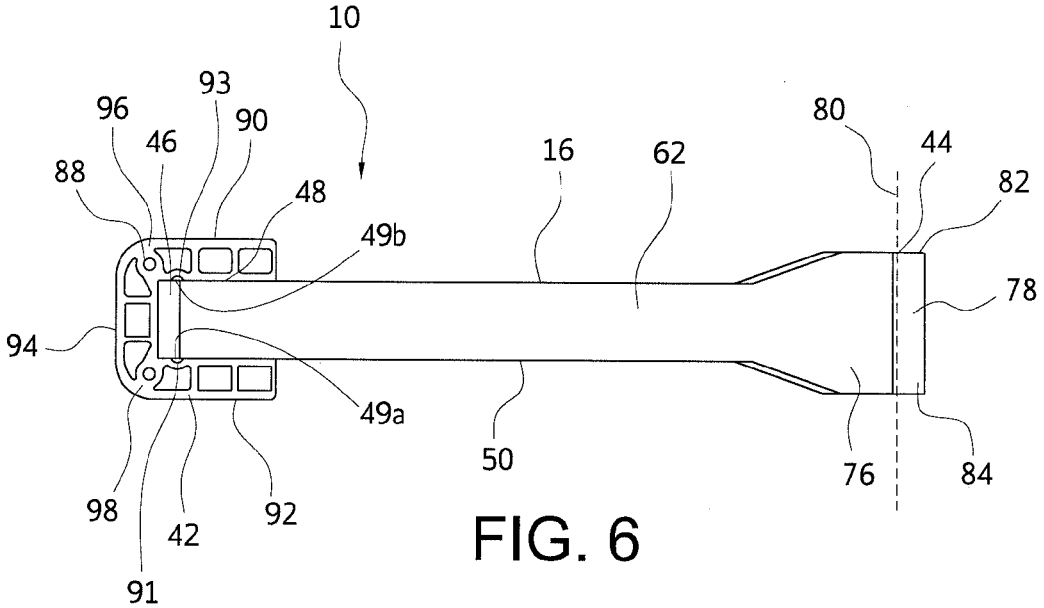
Figure 7:
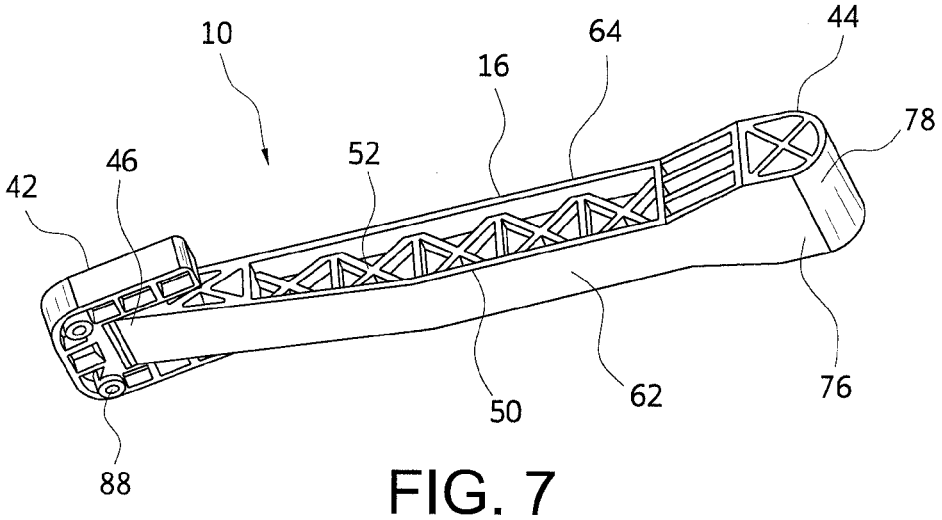
Figure 8:
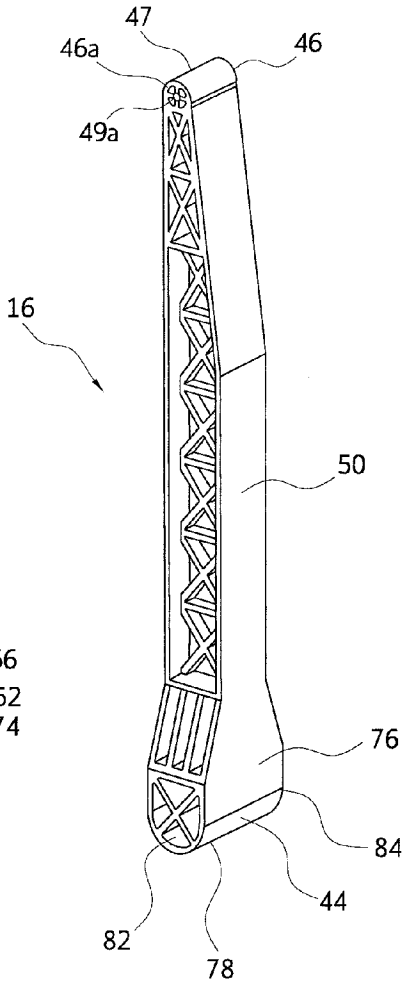
FIGS. 8, 9, 10, and 11 are respectively a perspective view, a top cross-sectional view along the line 9-9 in FIG. 10, a side view and a lateral cross sectional view along the line 11-11 in FIG. 10 of the mounting driver in accordance with the present invention.
Figure 11:
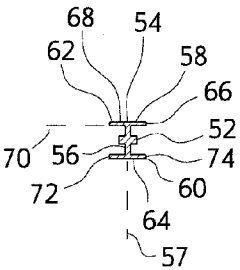
Figure 9:
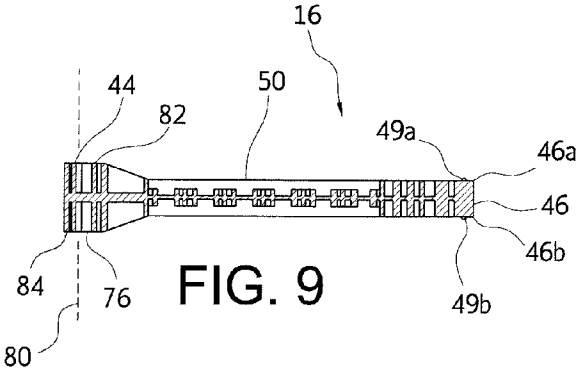
Figure 10:
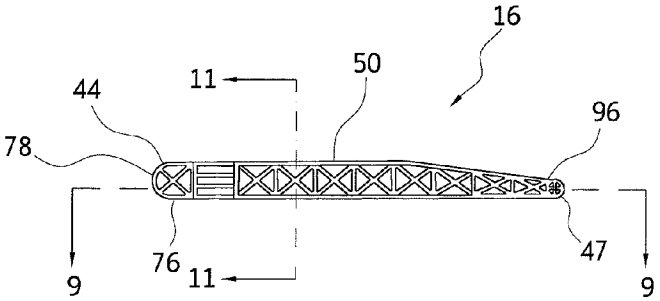
Figure 14:
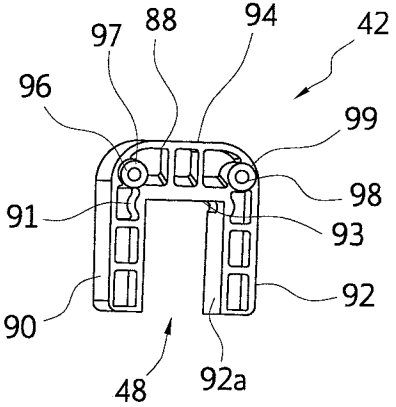
FIGS. 12, 13, 14 and 15 are respectively a side plan view, a bottom plan view, a perspective view and a cross sectional view along the line 15-15 in FIG. 13 of the mounting driver in accordance with the present invention.
Figure 15:
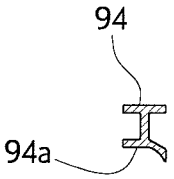
Figure 12:
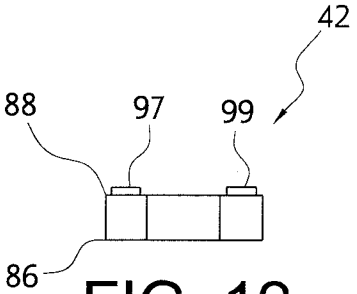
Figure 13:
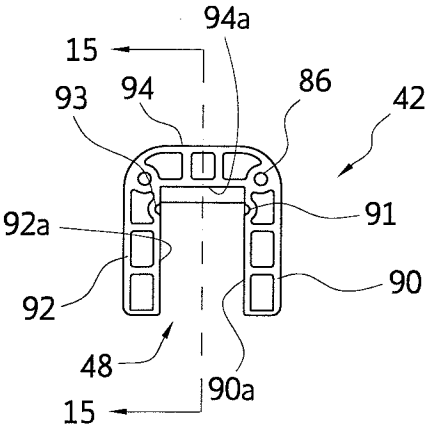

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 15, a mounting driver 10 for undermounting a sink 12 to a support surface 14 is disclosed. The mounting driver 10 includes a support bar 16 shaped and dimensioned for positioning between an underside 18 of the sink 12 and a mounting bracket 42 secured to a wall 20 of a cabinet 22 at an angular orientation relative to the wall 20.

As those skilled in the art certainly will appreciate, an undermounted sink 12 is positioned beneath the support surface 14 such that the rim 24 of the sink 12 is hidden beneath the support surface 14. Undermounting is most commonly employed in conjunction with granite countertops, but may be used in conjunction with a variety of surfacing materials within the spirit of the present invention.

With this in mind, and as will be fully appreciated based upon the following disclosure, the countertop, that is, the support surface, 14 includes an upper surface 26 and a lower surface 28, wherein the upper surface 26 is exposed to the external environment and the lower surface 28 faces downwardly, for example, into a cabinet 22 upon which the countertop 14 is mounted. A sink hole 30 is cut within the countertop 14 providing an opening into which the sink 12 is positioned. The sink hole 30 is shaped and dimensioned to substantially conform with the concave bowl 32 of the sink 12 such that the profile of the bowl 32 is aligned with the hole 30 when installation is complete.

As mentioned above, the sink 12 includes a concave bowl 32. The bowl 32 includes an outer circumference 34 from which a sink rim 24 extends. The sink rim 24 is substantially planar and sits within a plane aligned with the upper edge 38 of the concave bowl 32, that is, the outer circumference 34 of the concave bowl 32. As such, the sink rim 24 defines a substantially flat surface which may be positioned along the lower surface 28 of the countertop 14 preferably in the area adjacent the sink hole 30. When properly installed the concave bowl 32 will form a continuous surface with interior wall 40 of the sink hole 30, that is, the exposed portion of the countertop 14 extending between the upper surface 26 and the lower surface 28 when the sink hole 30 is cut in the countertop 14.

As briefly mentioned above, the mounting driver 10 is composed of a support bar 16 and a mounting bracket 42 extends between the underside 25 of the sink rim 24 and the wall 20 of a cabinet 22 upon which the countertop 14 is mounted. Both the support bar 16 and the mounting bracket 42 are preferably injection molded. The support bar 16 is a rigid, elongated member and includes a first end 44 and a second end 46, wherein the mounting bracket 42 is shaped and dimensioned for fixed attachment to the wall 20 of the cabinet 22 so as to support the second end 46 of the support bar 16 when installed in accordance with the present invention. The mounting bracket 42 includes a recess 48 shaped and dimensioned to receive the second end 46 of the support bar 16, such that when the first end 44 of the support bar 16 is pressed against the underside of the sink 12, in particular, the underside 25 of the sink rim 24 when the sink rim 24 is pressed upwardly into contact with the lower surface 28 of the countertop 14, the second end 46 of the support bar 16 is supported by the recess 48 of the mounting bracket 42 rigidly secured to the wall 20 of the cabinet 22 such that all of the downward force of the sink 12 is transferred to the mounting bracket 42 and ultimately the wall 20 of the cabinet 22 to which the mounting bracket 42 is secured.

The support bar 16 is a rigid, elongated member constructed with a trussed cross section increasing the strength and stability thereof. In particular, the support bar 16 includes a central support body 50 having an I-beam construction. That is, the central support body 50, when viewed along a cross sectional plane taken perpendicular to the longitudinal axis extending from the first end 44 of the elongated support bar 16 to the second end 46 of the elongated support bar 16, has a rectangular member 52 with a width 54 and a length 56 as well as a longitudinal axis 57 extending from a first end 58 of the rectangular member 52 to a second end 60 of the rectangular member 52 along the length 56 of the rectangular member 52. The central support body 50 also includes first and second cap members 62, 64 positioned at the first and second ends 58, 60 of the rectangular member 52. Each of the cap members 62, 64 also includes a width 66 and a length 68 as well as a longitudinal axis 70 extending from a first end 72 thereof to a second end 74 thereof wherein the longitudinal axes 70 of the cap members 62, 64 are perpendicular to the longitudinal axis 57 of the rectangular member 52.

Formed at the first end 44 of the support bar 16 is a sink engaging member 76. The sink engaging member 76 includes a curved surface 78 shaped and dimensioned to engage the underside 25 of the rim 24 of the sink 12 without damaging the sink 12. The sink engaging member 76 includes a long axis 80 which is substantially parallel to the longitudinal axes 70 of the cap members 62, 64 discussed above and perpendicular to the longitudinal axis 57 of the central support body 50. With this in mind, the distance from a first end 82 of the sink engaging member 76 to the second end 84 of the sink engaging member 76, that is, along a lateral length dimension substantially parallel to a plane tangent the curved surface 78 of the sink engaging member 76, is greater than the width 54 of the central support body 50.

The support bar 16 is constructed such that a tapered outward transition exists between the central support body 50 and the sink engaging member 76 so as to create the enlarged curved surface 78 of the sink engaging member 76. The enlarged construction of the sink engaging member 76 creates a greater surface area as the support bar 16 engages the underside 25 of the rim 24 of the sink 12. More particularly, and considering the fact that the support bar 16 has a longitudinal axis as it extends from the first end 44 thereof to the second end 46 thereof, the first end 44, that is, the sink engaging member 76, extends laterally outwardly from a plane bisecting the longitudinal axis of the support bar 16. The outward extension is symmetrical with respect to the plane.

As to the second end 46 of the support bar 16, it is consistent in width with the central support body 50 of the support bar 16, but tapers inwardly with respect to the length 56 of the central support body 50 such that it fits within the recess 48 of the mounting bracket 42. In particular, the back surface defined by the cap member 64 is flat from the first end 44 to the second end 46 of the support bar 16 while the front surface defined by the cap member 62 angles toward the back surface as it extends toward the second end 46 of the support bar 16. As with the first end 44, the second end 46 of the support bar 16 includes a rounded distal end 47. It is appreciated the curved surfaces at the first end 44 and the second end 46 of the support bar 16 allow for mounting of the support bar 16 at various angular orientations relative to the wall 20 of the cabinet 22 and the sink 12.

Referring now to the mounting bracket 42, it is substantially U-shaped and, therefore, includes the briefly discussed central recess 48. More particularly, the mounting bracket 42 is of rigid construction and has a substantially planar construction including wall engaging surface 86 and an exposed surface 88. When viewed looking downwardly onto either the wall engaging surface 86 or the exposed surface 88, the mounting bracket 42 includes a first leg 90, a second leg 92, and a connecting member 94 connecting the first leg 90 to the second leg 92. Because of the thickness of the mounting bracket 42 as it extends from the wall engaging surface 86 to the exposed surface 88, each of the first leg 90, the second leg 92, and the connecting member 94, includes an internal side wall 90*a*, 92*a*, 94*a*. The side walls 90*a*, 92*a*, 94*a* of these members respectively define the recess 48 in which the second end 46 of the support bar 16 sits when the device is positioned for supporting a sink 12. In accordance with a preferred embodiment, the side wall 94*a* of the connecting member 94, that is, the side wall 94*a* extending between the first leg 90 and the second leg 92, has a concave surface with a rounded profile matching the rounded distal end 47 at the second end 46 of the support bar 16. This round, concave surface forces the second end 46 of the support bar 16 into the concavity thereof during installation and prevents inadvertent dislodging of the support bar 16 from the mounting bracket 42 after installation.

Dislodgement is prevented and installation is enhanced by the provision of mating recesses 91, 93 and protrusions 49*a*, 49*b* respectfully provided on the side walls 90*a*, 92*a* of the first and second legs 90, 92 and the lateral edges 46*a*, 46*b* formed at the second end 46 of the support bar 16. In particular, when the second end 46 of the support bar 16 is positioned within the recess 48 of the mounting bracket 42, the rounded distal end 47 sits within the concave side wall 94*a*, while the protrusions 49*a*, 49*b* at the second end 46 of the support bar 16 snap into the pivot recesses 91, 93 of the side walls 90*a*, 92*a* of the first and second legs 90, 92. With this mating arrangement the second end 46 of the support bar 16 is frictionally held with the recess 48 and permitted to pivot relative thereto in a manner enhancing installation at various orientations.

The mounting bracket 42 also includes screw holes 96, 98 laterally extending therethrough, that is, from the exposed surface 88 to the wall engaging surface 86, for the passage of mounting screws 100 in accordance with the usage of the present invention. The screw holes 96, 98 are further provided with extending lips 97, 99 assisting in controlling the penetration of the screws upon installation. In accordance with a preferred embodiment, a first aperture 96 is formed in the base of the first leg 90, that is, adjacent the meeting point of the first leg 90 and the connecting member 94 and a second aperture 98 is formed in the base of a second leg 92, that is, adjacent the meeting point of the second leg 92 and the connecting member 94. The positioning of the apertures 96, 98, and the screws 100 associated therewith, is selected so as to optimize the distribution of forces when the mounting driver 10 is properly positioned for supporting a sink 12.

In practice, the sink 12 is held in position along the lower surface 28 of the countertop 14 with the rim 24 in alignment with the sink hole 30. The second end 46 of the support bar 16 is then snapped into the recess 48 of the mounting bracket 42. With the support bar 16 and mounting bracket 42 as a single unit, the first end 44 of the mounting driver 10 is pressed into engagement with the underside 25 of the rim 24. Upward pressure is applied to the mounting driver 10 with the mounting bracket 42 held against the wall 20 of the cabinet. Once the mounting driver 10 is positioned properly and adequate upward pressure is applied, screws 100 are passed through the screw holes 96, 98 and into the wall 20 of the cabinet 22. With the screws 100 applied, attachment is complete. It is appreciated that washers may be used in conjunction with the screws where deemed necessary and additional structural support may be incorporated to the installation process where the wall of the cabinet or other surface is not considered adequate to support the weight of the sink.

With the second end 46 of the support bar 16 securely positioned within the recess 48, the first end 44 in engagement with the under surface of the sink 12, and the mounting bracket 42 fixedly attached to the wall 20 of the cabinet 22, the weight of the sink 12 forces the second end 46 into the mounting bracket 42, which is supported by the screws 100 and the wall 20 of the cabinet 22, and creates a secure supporting structure for the sink 12. Multiple support mounting drivers 10 may be positioned at various locations about the circumference of the sink 12 to ensure proper support thereof.

It is appreciated the present mounting driver may be used in supporting both newly installed sinks and those sink which have been previously installed but require additional support due to the failure of the previously used mounting structure.

Figure 18:
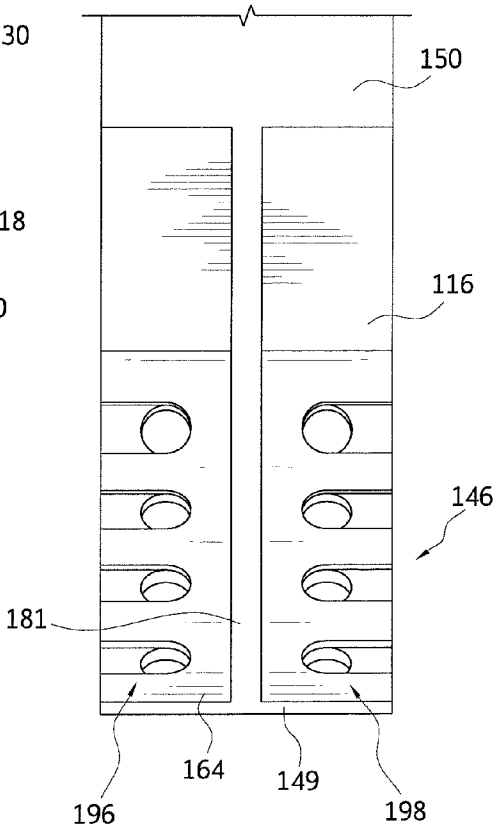
FIGS. 16, 17 and 18 are respectively a perspective view, a side view and a detailed plan view of a mounting driver in accordance with an alternate embodiment.
Figure 17:
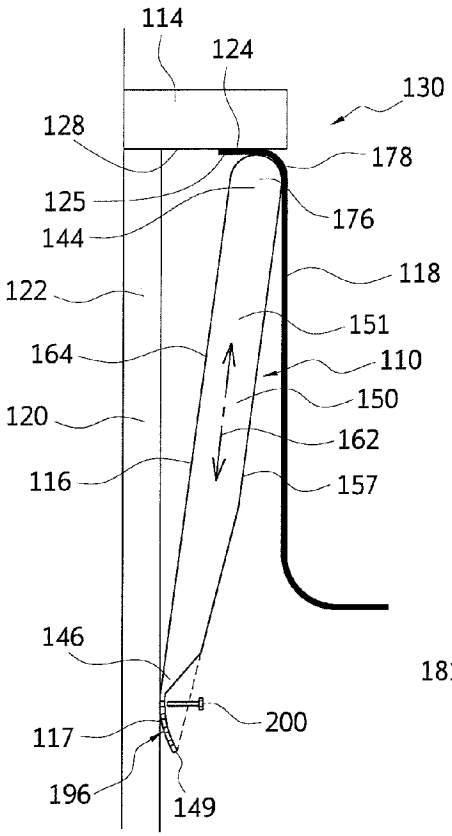
Figure 16:
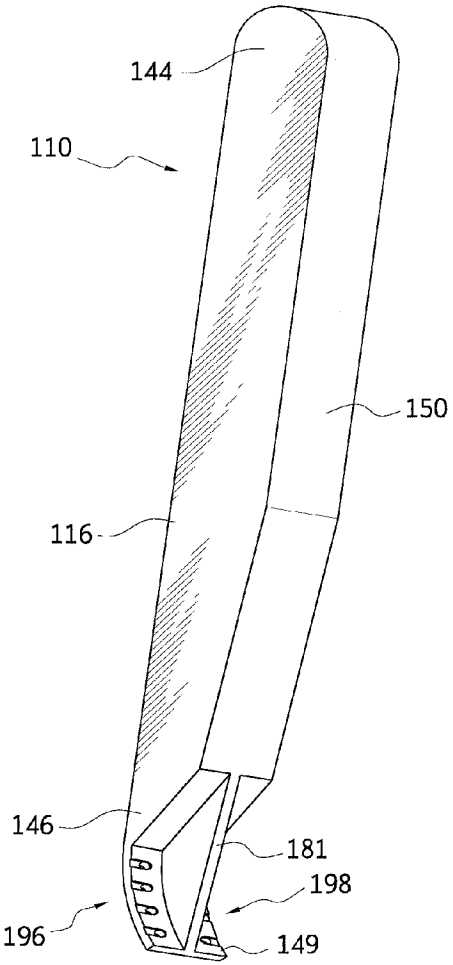
Figure 19:
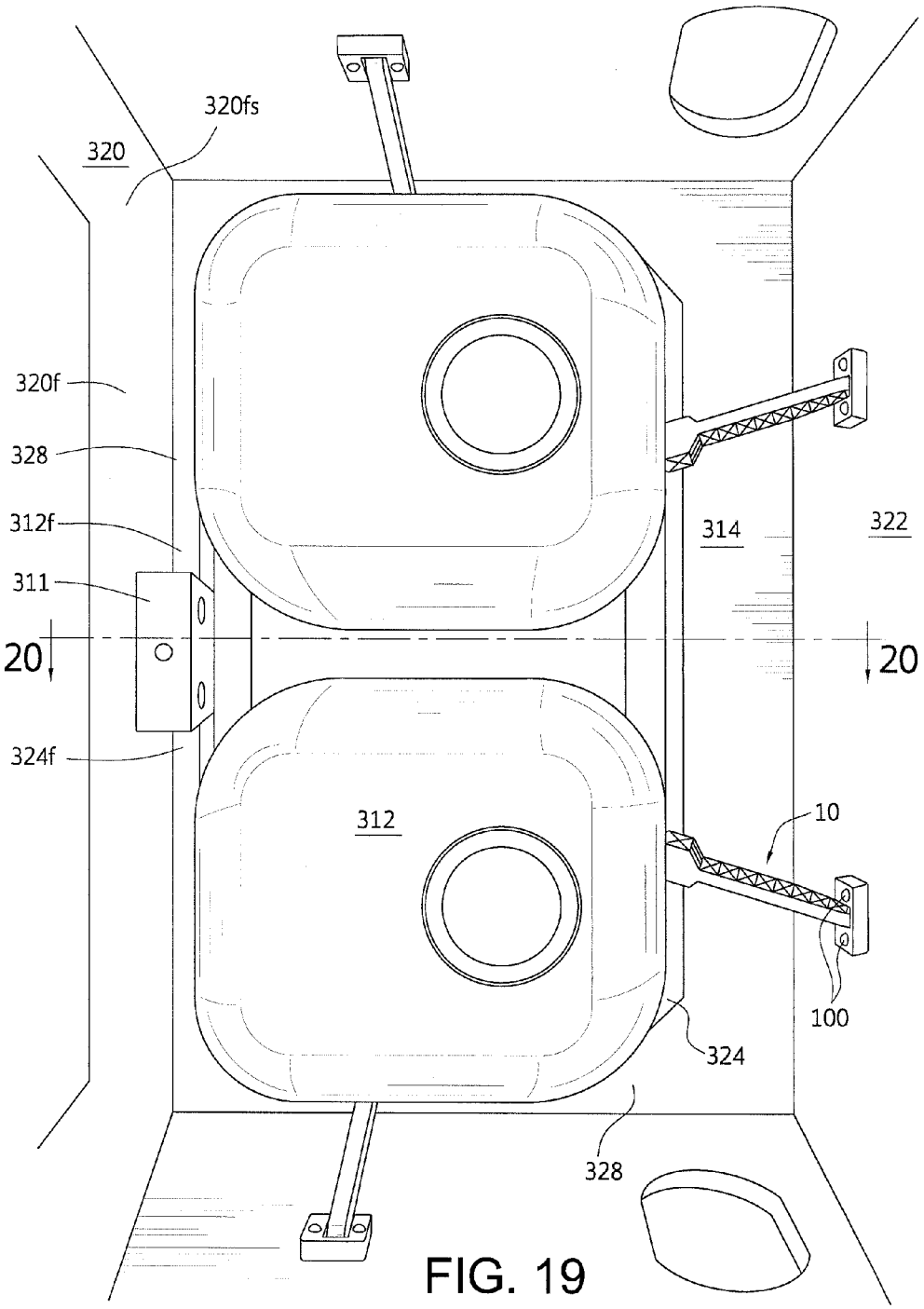
FIG. 19 is a bottom plan view of a sink mounting using a central sink support used in conjunction with the mounting driver of the present invention.
Figure 20:
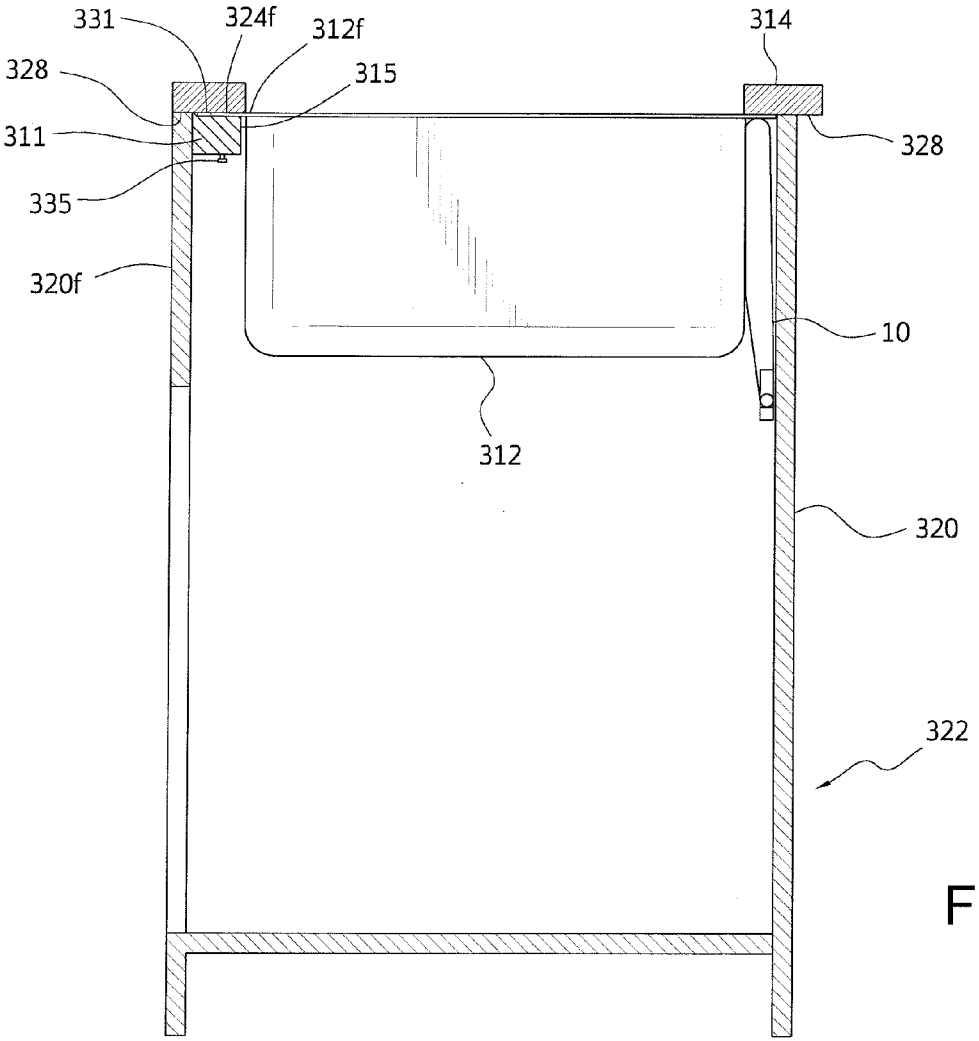
FIG. 20 is a side cross-sectional view along the line 20-20 in FIG. 19.
Figure 21:
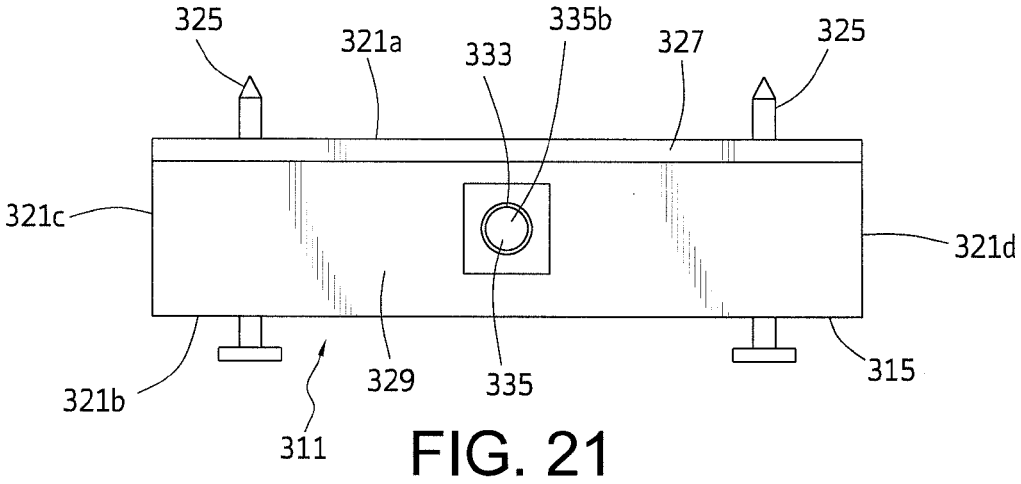
FIG. 21 is a top plan view of the central sink support shown in FIGS. 19 and 20.
Figure 22:
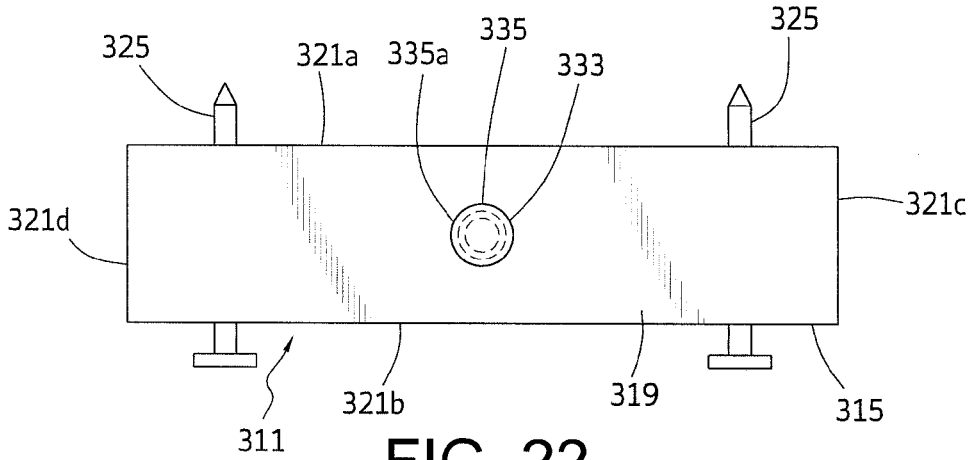
FIG. 22 is a bottom plan view of the central sink support shown in FIGS. 19 and 20.
Figure 23:
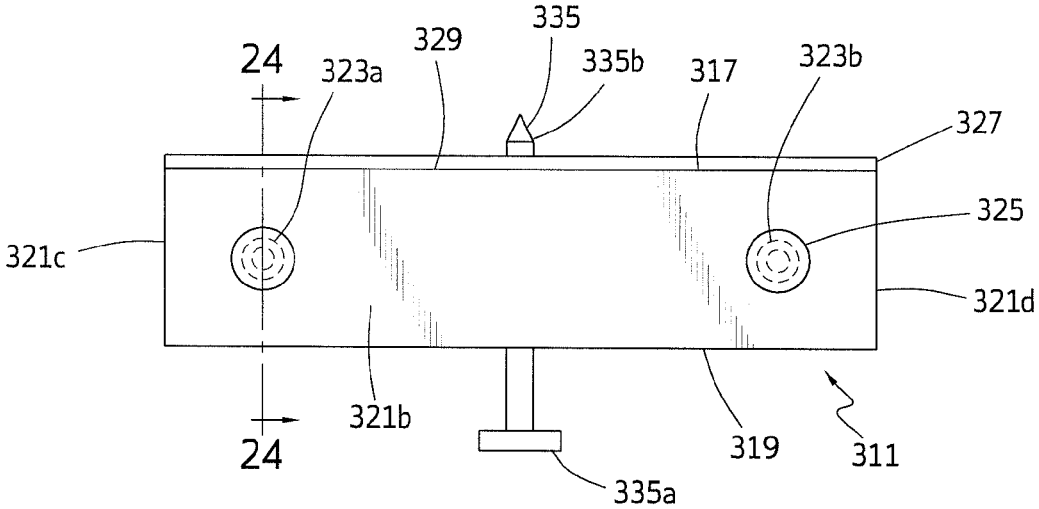
FIG. 23 is a side plan view of the central sink support shown in FIGS. 19 and 20.
Figure 24:
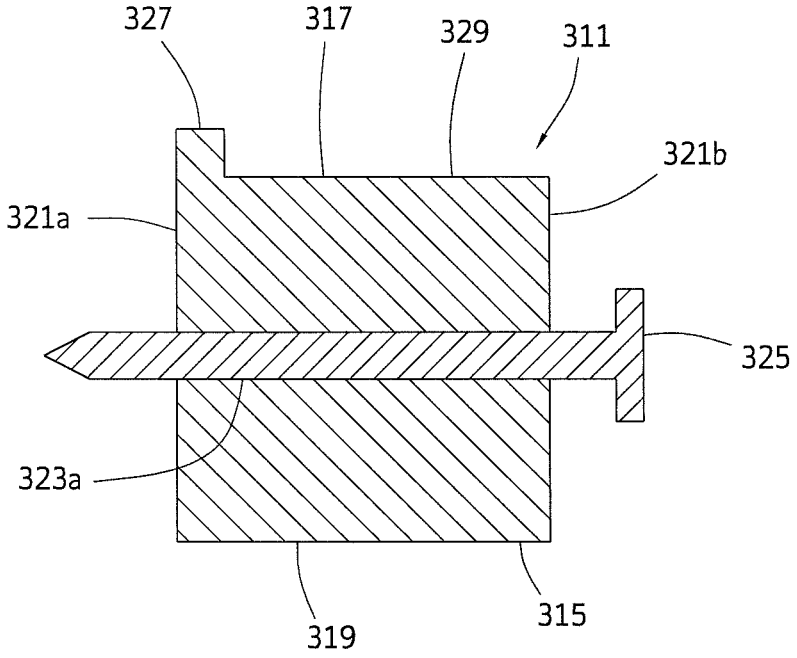
FIG. 24 is a cross-sectional view of the central sink support shown along the line 24-24 in FIG. 23.

It is also contemplated the mounting driver 110 may be constructed in a one-piece manner as shown with reference to FIGS. 16 to 18. In accordance with such an embodiment, the mounting driver 110 includes a support bar 116 shaped and dimensioned for positioning between an underside 118 of the sink 112, wherein the support bar includes an arcuate mounting surface 117 adapted for direct attachment to the wall 120 of a cabinet 122 at an angular orientation relative to the wall 120.

As with the prior embodiment, the support bar 116 is a rigid, elongated member and includes a first end 144 and a second end 146. As with the prior embodiment, the support bar is preferably injection molded. The support bar 116 in accordance with this embodiment only exhibits a trussed cross sectional construction in the areas of the first end 144 and the central support body 150. In particular, and as with the prior embodiment, the support bar 116 includes a central support body 150 having an I-beam construction as described above with regard to the embodiment of FIGS. 1-15. As such, the support bar 116 includes a back surface cap member 164 defining the back side of the support bar 116 and a front surface cap member 162 defining the front side of the support bar 116 with supporting internal structure 151 formed therebetween.

The support bar 116 also includes a sink engaging member 176 formed at the first end 144 of the support bar 116. As with the embodiment disclosed above with reference to FIGS. 1-15, the sink engaging member 176 includes a curved surface 178 shaped and dimensioned to engage the underside 125 of the rim 124 of the sink 112 without damaging the sink 112. The sink engaging member 176 also includes a long axis which is substantially perpendicular to the longitudinal axis 157 of the central support body 150. With this in mind, and as with the embodiment described above with reference to FIGS. 1-15, the distance from a lateral first end of the sink engaging member 176 to the lateral second end of the sink engaging member 176 is greater than the width of the central support body 150.

The support bar 116 is constructed such that a tapered outward transition exists between the central support body 150 and the sink engaging member 176 so as to create the enlarged curved surface 178 of the sink engaging member 176. The enlarged construction of the sink engaging member 176 creates a greater surface area as the support bar 116 engages the underside 125 of the rim 124 of the sink 112. More particularly, and considering the fact that the support bar 116 has a longitudinal axis as it extends from the first end 144 thereof to the second end 146 thereof, the first end 144, that is, the sink engaging member 176, extends laterally outwardly from a plane bisecting the longitudinal axis of the support bar 116. The outward extension is symmetrical with respect to the plane.

As to the second end 146 of the support bar 116, it is consistent in width with the central support body 150 of the support bar 116, but exhibits a curvature as it extends from the central support body 150 to the distal end 149 of the support bar 116 at the second end 146 thereof. In particular, the back side defined by the back surface cap member 164 is flat from the first end 144 of the support bar 116 to the central support body 150 of the support bar 116, but exhibits a curved surface at the second end 146 of the support bar 116. As to the front side defined by the front surface cap member 162, as well as the central trussed supporting structure 163 between the back surface cap member 164 and the front surface cap member 162, they end at the point 165 where the central support body 150 turns into the second end 146 of the support bar 116. The removal of this structure at this point allows for access to the back surface cap member 164, from the front side of the mounting driver 110, as will be appreciated based upon the following disclosure.

More particularly, the second end 146 of the support bar 116 is curved such that the back surface cap member 164 defines a concave surface 167 along the back side 116*b* of the support bar 116. This back surface cap member 164 is ultimately shaped and dimensioned for positioning along the wall 120 of the cabinet 122 during the installation process.

In particular, the concave surface 167 has a radius of curvature. The concave surface 167 extends about a central point through which a second end central axis 171 normal to the plane symmetrically bisecting the second end 146 extends.

Extending through the back surface cap member 164 are two sets of holes 196, 198 formed along the length of the second end 146 of the support bar 116 allowing the second end 146 of the support bar 116 to function as a mounting bracket. These holes 196, 198 allow for various angular orientations of the support bar 116 during installation while simultaneously permitting an installer to drive the screws 200 straight into the wall 120 of the cabinet 122 (or other support structure).

As discussed above, the front surface cap member 162 defining the front side of the support bar 116 ceases as the central support body 150 transitions into the second end 146 of the support bar 116. As such, the second end 146 is not constructed with the same truss construction employed with the first end 144 and the central support body 150. Rather, the second end 146 of the support bar 116 includes a support beam 181 extending along the second end 146 of the support bar 116 from the central support body 150 to the distal end 149 of the support bar 116 at the second end 146 thereof. The support beam 181 bisects the back surface cap member 164 and lies in a plane that is perpendicular to the back side of the support bar 116 surface defined by the back surface cap member 164. As such, and considering the first and second sets of holes 196, 198 discussed above, the first set of holes 196 is positioned on one side of the support beam 181 and the second set of holes 198 is positioned on the other side of the support beam 181. While a series of spaced holes are disclosed in accordance with a preferred embodiment, it is appreciated a slot might also be employed to provide for versatility in the positioning of the support arm during installation.

In practice, the sink 112 is held in position along the lower surface 128 of the countertop 114 with the rim 124 in alignment with the sink hole 130. The first end 144 of the mounting driver 110, that is, the support bar 116, is pressed into engagement with the underside 125 of the rim 124. Upward pressure is applied to the mounting driver 110 with the second end 146 of the support bar 116 held against the wall 120 of the cabinet 122.

The ability to secure the first end 144 of the support bar 116 to the underside 125 of the rim 124 at various angular orientations while the second end 146 of the support bar is held against the wall 120 of the cabinet 122, is facilitated by relationship between the curved concave surface 167 at the back side 116*b* of the support bar 116 at the second end thereof and the curved surface 178 of the sink engaging member 176. In particular, because the second end central axis is parallel to a first end central axis about which the curved surface 178 of the first end 144 extends, the support bar 116 may be oriented at a wide variety of angles during installation allowing for use in a variety of different cabinet and sink arrangements.

Once the mounting driver 110 is positioned properly and adequate upward pressure is applied, screws 200 are passed through the selected screw holes 196, 198 and into the wall 120 of the cabinet 122. It is appreciated the preferred screw holes 196, 198 will be those allowing for the perpendicular application of a screw 200 into the wall 120 of the cabinet 122. With the screws 200 applied, attachment is complete. It is appreciated that washers may be used in conjunction with the screws where deemed necessary and additional structural support may be incorporated to the installation process where the wall of the cabinet or other surface is not considered adequate to support the weight of the sink.

In accordance with yet another embodiment, either the mounting driver 10 of FIGS. 1-15 or the mounting driver 110 of FIGS. 16-18 may be employed in conjunction with a central sink support 311 designed to support the front center portion 312*f* of the sink 312 during the installation process (although the embodiment of FIGS. 1-15 is shown in the exemplary drawings). As will be appreciated based upon the following disclosure, the central sink support 311 is secured to the front wall 320*f* of the sink cabinet 322. Thereafter, the front rim 324*f* of the sink 312 is secured between the central sink support 311 and the lower surface 328 of the countertop 314. Thereafter, the mounting drivers 10, 110 are secured to the sink 312 and cabinet 322 as desired. Finally, the locking screw 335 of the central sink support 311 is turned to lock the sink rim 324 in place.

Referring now to FIGS. 19 to 24, the central sink support 311 includes an elongated block member 315. The elongated block member 315 includes an upper surface 317, a lower surface 319 and extending sidewalls 321*a*, 321*b*, 321*c*, 321*d* therebetween. The extending sidewalls include a front sidewall 321*a*, a rear sidewall 321*b*, a lateral left sidewall 321*c* and a lateral right sidewall 321*d*. Extending between the front sidewall 321*a* and the rear sidewall 321*b* (and through the block member 315) are first and second screw holes 323*a*, 323*b* shaped and dimensioned for the passage of screws 325 therethrough. These screws 325 will be secured to the front wall 320*f* of the sink cabinet 322 during the installation process. The first and second screw holes 323*a*, 323*b* are positioned symmetrically on opposite sides of the central sink support 311 such that they are located adjacent to the lateral left sidewall 321*c* and the lateral right sidewall 321*d* and between the upper surface 317 and the lower surface 319 thereof.

With the exception of the upper surface 317, the lower surface 319 and the sidewalls 321*a-d* are flat planar surfaces. As will be appreciated based upon the following disclosure, the upper surface 317 includes an upwardly extending stop 327 positioned on the upper surface 317 and adjacent to the front sidewall 321*a*. The upwardly extending stop extends from lateral left sidewall 231*c* to the lateral right sidewall 321*d*. As such, the upper surface 317 is considered to include a primary planar surface 329, as well as the upwardly extending stop 327 extending above the primary planar surface 329.

The upwardly extending stop 327 provides a mechanism for positioning the central sink support 311 on the lower surface 328 of the countertop 314 such that a gap 331 exists between the primary planar surface 329 of the upper surface 317 and the lower surface 328 of the countertop 314. With this in mind, the primary planar surface 329 of the upper surface 317 is flat and provides a surface upon which the front rim 324*f* of the sink 312 is positioned.

In addition to the screw holes 323*a*, 323*b* previously discussed, a threaded locking pin hole 333 is provided between the upper surface 317 and the lower surface 319 (and extending through the block member 315). As such, the threaded locking pin hole 333 is oriented perpendicular to the first and second screw holes 323*a*, 323*b*. The threaded locking pin hole 333 is shaped and dimensioned for accommodating a similarly threaded locking screw 335 that will extend from the lower surface 319 of the central sink support 311 to the upper surface 317 of the central sink support 311 for selective engagement with the rim 324 of the sink during installation. The threaded locking screw 335 includes a first end 335*a* shaped and dimensioned for engagement with a turning tool (e.g., screw driver, ratchet, etc.) and a second end 335*b* shaped and dimensioned for engagement with the rim 324 of the sink 312 as one turns the first end 335*a* of the locking screw 335 to extend or retract the locking screw 335.

With the above description in mind, installation utilizing the central sink support will now be described in detail. First, the central sink support 311 is positioned beneath the countertop 314 along the front wall 320*f* of the sink cabinet 322 with the front sidewall 321*a* abutting the interior surface 320*fs* of the front wall 320*f* of the sink cabinet 322 and the upwardly extending stop 327 in contact with the lower surface 328 of the countertop 314. With the central sink support 311 in this position, screws 325 are passed through the first and second screw holes 323*a*, 323*b* and the screws 325 are secured into the front wall 320*f* of the sink cabinet 322. With the central sink support 311 secured to the front wall 320*f* of the sink cabinet 322, a gap 331 exists between the lower surface 328 of the countertop 314 and the upper surface 317 of the central sink support 311. Within this gap 331, the front rim 324*f* of the sink 312 is positioned and the locking screw 335 is turned so as to bring the second end 335*b* thereof into engagement with the sink rim 324 and firmly secure the sink rim 324 between the central sink support 311 and the underside of the countertop 314. With the sink 312 positioned as such, the rear mounting driver 10, 110 is secured as described above. Thereafter, left and right mounting drivers 10, 110 may be secured as required.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An assembly for undermounting a sink to a support surface, comprising:

a central sink support supporting a front center portion of a sink, the central sink support comprising:

an elongated block member having an upper surface, a lower surface and extending sidewalls;

first and second screw holes shaped and dimensioned for the passage of screws that will be secured to a front wall of a sink cabinet; and a threaded locking pin hole with a similarly threaded locking screw;

a mounting driver, comprising:

a support bar shaped and dimensioned for positioning between an underside of the sink and a wall of a cabinet at an angular orientation relative to the wall, the support bar including a first end and a second end.

2. The assembly for undermounting a sink according to claim 1, wherein the extending sidewalls include a front sidewall, a rear sidewall, a lateral left sidewall and a lateral right sidewall.

3. The assembly for undermounting a sink according to claim 2, wherein the first and second screw holes extend between the front sidewall and the rear sidewall.

4. The assembly for undermounting a sink according to claim 3, wherein the first and second screw holes are positioned symmetrically on opposite sides of the central sink support such that they are located adjacent to the lateral left sidewall and the lateral right sidewall and between the upper surface and the lower surface thereof.

5. The assembly for undermounting a sink according to claim 3, wherein the threaded locking pin hole extends between the upper surface and the lower surface, and the threaded locking pin hole is oriented perpendicular to the first and second screw holes.

6. The assembly for undermounting a sink according to claim 2, wherein the threaded locking pin hole extends between the upper surface and the lower surface.

7. The assembly for undermounting a sink according to claim 1, wherein the upper surface includes an upwardly extending stop positioned on the upper surface.

8. The assembly for undermounting a sink according to claim 1, wherein the upper surface includes an upwardly extending stop positioned on the upper surface and adjacent to a front sidewall of the central sink support.

9. The assembly for undermounting a sink according to claim 1, wherein the threaded locking pin hole extends between the upper surface and the lower surface.

10. The assembly for undermounting a sink according to claim 1, wherein the mounting driver also includes a mounting bracket shaped and dimensioned for fixed attachment to the wall of the cabinet, the support bar being pivotally coupled to the mounting bracket.

* * * * *